US006276277B1

(12) United States Patent
Schmacker

(10) Patent No.: US 6,276,277 B1
(45) Date of Patent: Aug. 21, 2001

(54) ROCKET-BOOSTED GUIDED HARD TARGET PENETRATOR

(75) Inventor: Bruce E. Schmacker, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/295,594

(22) Filed: Apr. 22, 1999

(51) Int. Cl.[7] ..... F42B 10/00

(52) U.S. Cl. ..... 102/384; 102/386; 102/518; 102/519; 102/374

(58) Field of Search ..... 102/518, 519, 102/384, 386, 374

(56) References Cited

U.S. PATENT DOCUMENTS

| | | | | |
|---|---|---|---|---|
| 3,302,570 | * | 2/1967 | Marquardt | 102/519 X |
| 3,754,507 | * | 8/1973 | Dillinger et al. | 102/518 X |
| 3,897,730 | | 8/1975 | Riparbelli | 102/52 |
| 3,935,817 | | 2/1976 | Riparbelli | 102/52 |
| 3,981,243 | * | 9/1976 | Doris, Jr. | 102/519 X |
| 4,016,817 | * | 4/1977 | Blanco | 102/519 |
| 4,131,246 | | 12/1978 | Rotmans | 244/3.32 |
| 4,290,364 | * | 9/1981 | Weidenshagen et al. | 102/384 |
| 4,301,737 | * | 11/1981 | Yahash et al. | 102/518 |
| 4,327,886 | | 5/1982 | Bell et al. | 244/3.29 |
| 4,463,921 | | 8/1984 | Metz | 244/3.22 |
| 4,488,487 | | 12/1984 | Croizer | 102/382 |
| 4,573,412 | | 3/1986 | Lovelace et al. | 102/387 |
| 4,697,525 | * | 10/1987 | Bocker et al. | 102/518 |
| 4,876,963 | | 10/1989 | Deffayet | 102/387 |
| 4,892,268 | | 1/1990 | Peretti et al. | 244/3.1 |
| 4,898,342 | | 2/1990 | Kranz et al. | 244/3.21 |
| 5,000,093 | * | 3/1991 | Bozner et al. | 102/519 X |
| 5,022,608 | | 6/1991 | Beam | 244/3.18 |
| 5,038,684 | * | 8/1991 | Petrovitch et al. | 102/518 X |
| 5,076,511 | | 12/1991 | Stein et al. | 244/3.22 |
| 5,109,774 | | 5/1992 | Deffayet | 102/382 |
| 5,189,248 | | 2/1993 | Deffayet et al. | 102/386 |
| 5,216,611 | | 6/1993 | McElreath | 364/454 |
| 5,440,993 | | 8/1995 | Osofsky | 102/374 |
| 5,544,586 | | 8/1996 | Huerta | 102/374 |
| 5,596,166 | | 1/1997 | Gould | 102/362 |
| 5,649,488 | | 7/1997 | Morrison et al. | 102/518 |
| 5,698,814 | | 12/1997 | Parsons et al. | 102/428 |
| 6,119,600 | * | 9/2000 | Burri | 102/518 X |

OTHER PUBLICATIONS

U.S. Statutory Invention Registration No. H1049, Khadduri et al.

U.S. Statutory Invention Registration No. H867, Hill.

Military Standard "Hazard Assessment Tests for Non-Nuclear Munitions" Department of Defense.

* cited by examiner

*Primary Examiner*—Peter A. Nelson
(74) *Attorney, Agent, or Firm*—Burns, Doane Swecker & Mathis, LLP

(57) ABSTRACT

A target-penetrating aerial bomb includes a penetrator of hard steel or similar material that contains an explosive charge. A rocket motor is formed as an annular chamber and surrounds the penetrator. The bomb includes a guidance and control unit that guides the bomb on a glide path after release from the delivery aircraft, and steers the bomb onto a dive line. Once the bomb is aligned on the dive line, the guidance and control unit fires the rocket booster to accelerate the bomb to the target. A fuse ignites the explosive after target penetration.

17 Claims, 5 Drawing Sheets

ROCKET-BOOSTED GUIDED HARD TARGET PENETRATOR

The present invention relates to aerial bombs, that is, bombs dropped from airborne vehicles, and more particularly, to aerial bombs for penetrating hard targets.

BACKGROUND AND SUMMARY OF THE INVENTION

Various types of penetrating bombs for attacking hardened targets are known. Penetrating bombs generally include a penetrator, a hard casing with an interior cavity for containing an explosive and a fuze to ignite the explosive. The bomb may include a guidance system to direct it to a target after release from an aircraft.

The ability of a penetrator to penetrate a target is proportional to the mass and the velocity of impact of the bomb and inversely proportional to the cross-sectional area of the bomb. In general, the greater the kinetic energy and the smaller the cross-sectional area, the greater the amount of penetration that can be expected. The cross-sectional area must, on the other hand, be sufficiently large to accommodate an internal cavity for carrying an explosive, and provide sufficient penetrator mass to withstand impact without breaking up so that penetration occurs.

Hardened targets, for example, below ground bunkers, have various features to defeat penetrating bombs. Typically, a hardened target includes layers of reinforced concrete, sand, earth, and rock, in various combinations and quantities to absorb or deflect the kinetic energy and explosive force energy of a penetrating bomb. In addition, voids or spaces may be provided between solid reinforcing layers, which allow an adjacent layer to collapse to absorb energy. Voids are also used to defeat fuzing systems that ignite the explosive when a void is sensed.

To overcome the increasingly sophisticated and effective protection features, ways of increasing the penetrating ability of the weapons have become needed. The present invention provides a solution by combining a rocket booster motor with a hard target penetrator in a structure that is compatible with current aircraft bomb carrying systems.

According to the invention, the bomb includes a penetrator formed as a hollow cylindrical body with a ogive shaped nose. The penetrator is formed from a tough, strong metallic alloy, and has a wall thickness sufficient to maintain structural integrity during penetration of a target so the penetrator will not buckle or collapse upon impact and penetration. The hollow interior contains an explosive or other payload and a fuze that initiates the explosive or other payload after the target has been penetrated. The penetrator may break into fragments from the force of the explosive or other payload, which adds to the effectiveness of the bomb.

According to a preferred embodiment of the invention, the rocket booster motor is configured as a wrap around unit, that is, an annular chamber that surrounds the penetrator. At least one exhaust nozzle, and preferably a plurality of nozzles, is positioned at an aft end of the rocket motor to provide propulsion. The wrap around rocket configuration results in a bomb with a penetrator having a practical length nearly equal to the bomb length, thus providing for an efficient penetrator size.

The invention also includes a guidance system for guiding the bomb after release from the aircraft, and for directing the bomb to the target.

According to a preferred embodiment of the invention, the guidance system includes an inertial navigation system (INS) with a global positioning system (GPS) that allows the guidance system to determine its location without assistance from the delivery aircraft. The guidance system uses vanes, that is, fins and wings, to control the flight of the bomb.

The guidance system according to the invention also includes accelerometers to sense accelerations experienced by the bomb for use in correcting the attitude of the bomb. Data from the accelerometers is used by the guidance system to control the wings or fins, or other control surfaces on the bomb.

According to the invention, the bomb includes a fuze for initiating the explosive or other payload after penetration of the target. The fuze can include, alternatively, a time delay or a layer sensing device for controlling when initiation occurs.

BRIEF DESCRIPTION OF THE DRAWINGS

The invention will be better understood by reference to the following detailed description in conjunction with the appended drawings, in which.

DETAILED DESCRIPTION

Figure 1:
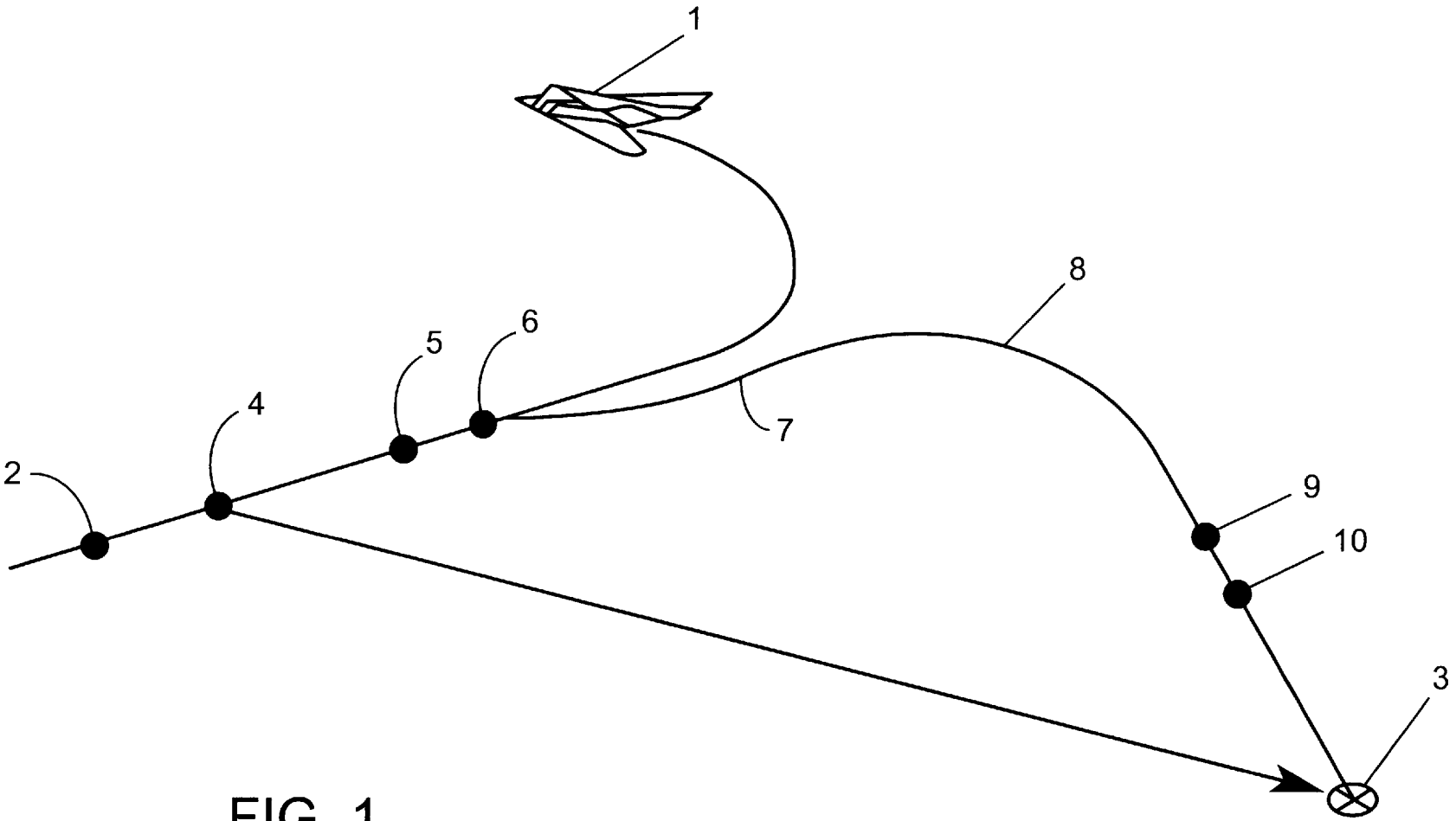
FIG. 1 is a schematic illustration of the release and flight phases of a guided boosted bomb in accordance with the invention.

A rocket boosted hard target penetrating bomb in accordance with the invention is designed to be delivered by an aircraft 1, for example, a fighter plane or a bomber, as illustrated schematically in FIG. 1. When the aircraft 1 prepares for release of the bomb, the bomb's on-board systems (a computer controlled guidance system and the fuze) will be powered up, as indicated by step 2. The aircraft 1 locates the target 3 at step 4, and determines the safe release range 5. The bomb is released within the safe release range at step 6. The bomb includes aerodynamic features that permit it to glide on a path 7 before diving to the target. As discussed below, the bomb has a guidance system for guiding the bomb to the proximity of the target and performing a maneuver 8 to position the bomb onto a dive line 9 to the target. If the bomb was released at a relatively low altitude, the maneuver 8 may include a slight climb and a pitch over to achieve the dive line. Once on the dive line 9, and when an appropriate distance above the target (described below) the bomb guidance and control system activates a rocket booster at step 10 to accelerate the bomb for maximal kinetic energy at target impact.

Figure 2:
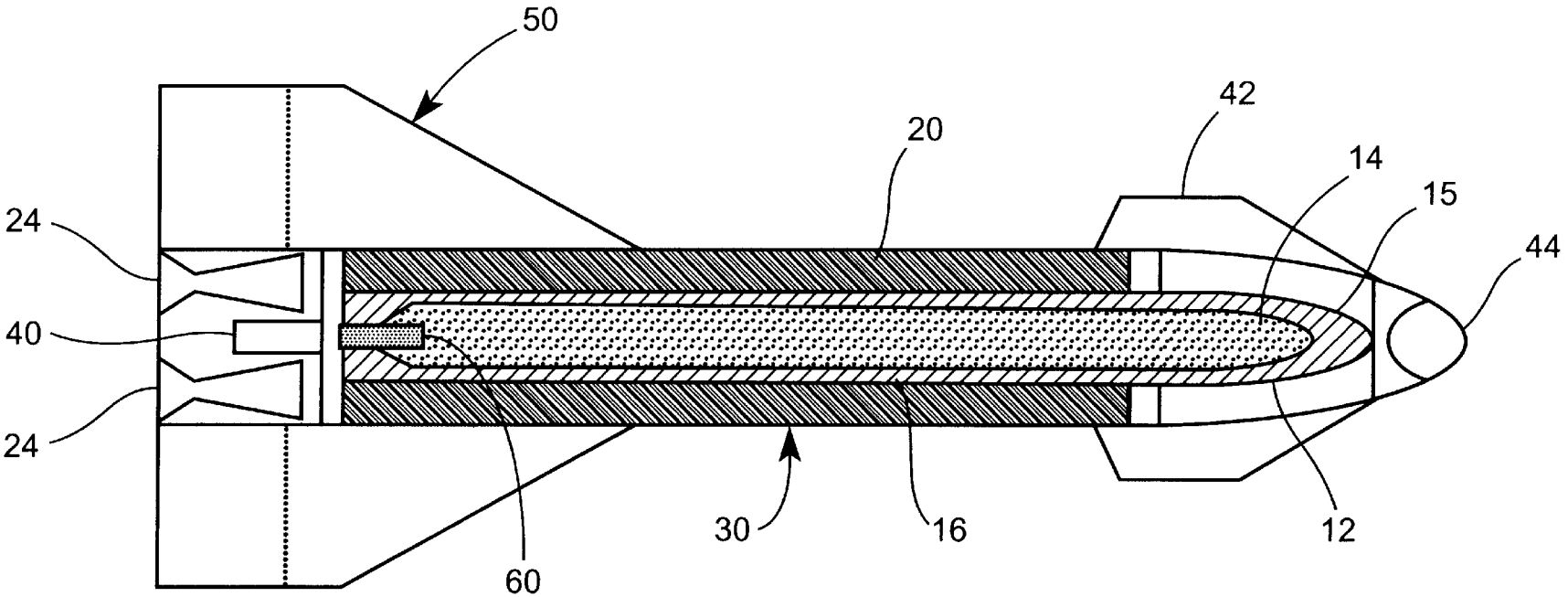
FIG. 2 is a schematic illustration of a rocket boosted penetrating bomb in accordance with the invention.

A boosted penetrating bomb according to a preferred embodiment of the invention is illustrated schematically in FIG. 2. The bomb includes a penetrator 12, an elongated, hollow, hard body containing a payload 14, preferably an explosive medium. Other payloads may be used, for example, fragmenting bomblets, chemicals, incendiaries, and radioactive material. A rocket booster motor 20 for accelerating the penetrator 10 includes an annular fuel chamber 22 and a plurality of exhaust nozzles 24. The annular chamber 22 defines a central interior space in which the penetrator 10 is mounted. Space constraints in aircraft bomb racks limit the overall size of bombs, making efficient use of space an important consideration. The annular booster structure has the advantage of accommodating a penetrator 10 with a length approximately the entire available length of the bomb, thus, maximizing the use of space and accordingly, the efficiency of the design.

An outer skin or shroud 30 encloses at least parts of the booster motor 20 and penetrator 10 to provide an aerodynamic shape. Conveniently, the outer surface of the rocket motor 20 serves as part of the shroud shown in FIG. 2, with additional nose and tail pieces to enclose the nose 15 of the penetrator and the nozzles 24. Advantageously, the mass of the penetrator 10 and rocket motor 20 are distributed and the shroud is shaped so that the overall shape and configuration of the bomb emulates an existing, qualified bomb to facilitate qualification of the bomb for use with existing aircraft. International Application No. PCT/US97/23112 describes a bomb made to emulate a qualified bomb, the disclosure of which is incorporated herein by reference. As an example, a bomb having rocket motor with an outer diameter of 17 inches and with a penetrator having a length of 94.5 inches can be made to emulate the shape, weight, and inertial characteristics of the GBU-27.

The mounting structure holding the penetrator 10 to the rocket booster motor 20 and the shroud 30 must be capable of supporting the penetrator 10 during the boost phase (while the rocket is firing), but also release the penetrator at target impact with a minimal loss of kinetic energy. Preferably, circular clamps and pads using shear pins mount between the penetrator and rocket motor to connect the penetrator 10 with the rocket motor 20. The shear pins are selected to withstand rocket acceleration, but to break at impact forces.

The effectiveness of a penetrating bomb depends on several factors. The guidance package must, of course, accurately guide the bomb to the target so that the bomb strikes within an acceptable margin of error of the target. A dive line approximately perpendicular to the target protective structures provides optimal penetration. A perpendicular dive line sets the penetrator on the shortest distance through the protective layers. Deviations from a vertical dive line will cause the penetrator to travel diagonally through the protective layers, which increases the distance traveled. At the extreme, if the dive line is too far from perpendicular, the penetrator may bounce off the target.

Figure 3:
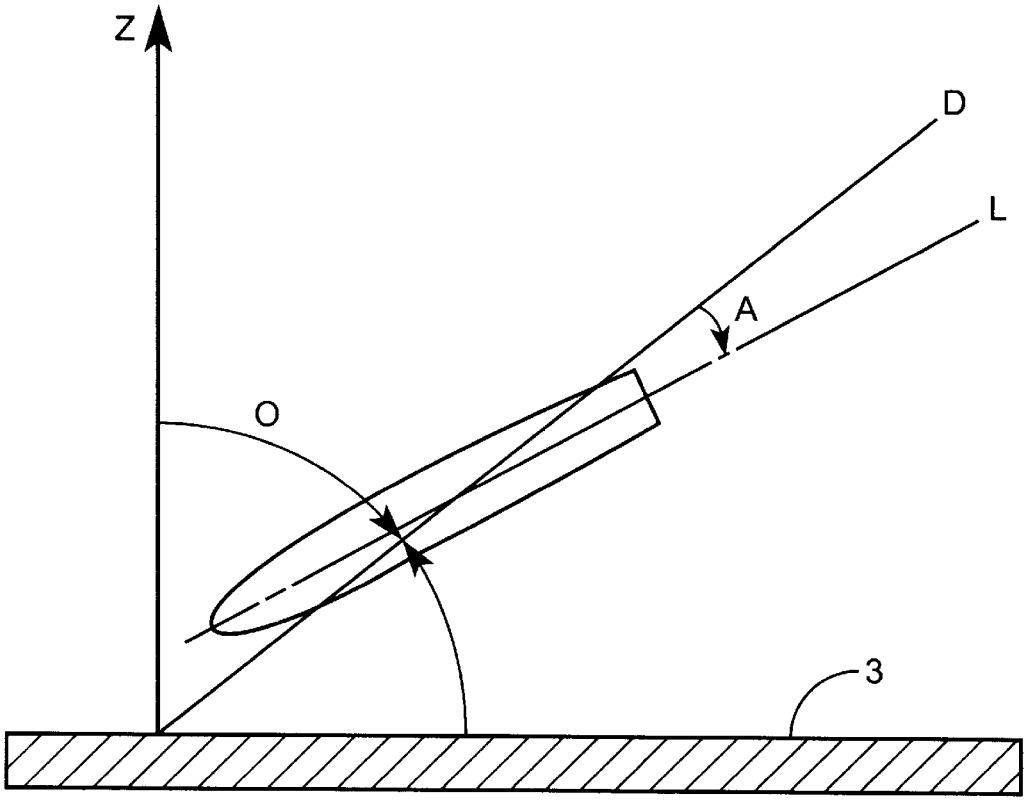
FIG. 3 is a diagram showing the relationship between the dive line and angle of attack for a bomb.

In addition, the angle of attack, that is, the angle of the long axis of the bomb relative to the dive line, should be at a minimum, and optimally zero. FIG. 3 illustrates the relationship between the dive line and the angle of attack. A horizontal target 3 is illustrated, and the axis Z indicates the vertical or perpendicular relative to the target. The angle of obliquity O is the deviation of the dive line D from the vertical, which is exaggerated in the figure for clarity of the illustration. For optimal penetration, the angle of obliquity O should be as close to perpendicular as possible, and no greater than about 20° from perpendicular. The angle of attack A is the deviation of the long axis L of the bomb from the dive line D. As may be appreciated from FIG. 3, if the angle of attack deviates too far from the dive line, once the nose penetrates, the body of the penetrator could buckle or rotate about the nose. In a worst case angle of attack, the penetrator could strike the target with its side rather than the nose and fail to penetrate the target at all.

The bomb includes a guidance and control unit (GCU) 40 including an onboard computer and a navigation system. Control vanes, that is nose wings 42 and tail fins 50, are controllable by the GCU 40 to steer the bomb after release from the aircraft. The GCU navigation system is preferably an inertial navigation system (INS) of the type currently used in guided bombs. Information on the position, velocity, and attitude of the aircraft at release of the bomb must be provided to the bomb navigation system and the system must be calibrated before release from the aircraft. A global positioning system (GPS) on board the aircraft could supply this information to the bomb. Alternatively, relative target position data from a target sensing system (e.g., laser seeker or radiation seeker) and aircraft velocity information could be provided to the bomb's guidance system at release.

Alternatively and preferably, the bomb guidance package includes an on-board GPS receiver 44, shown in FIG. 1 as mounted on the nose. The GPS receiver 44 receives location information from a GPS satellite, which frees the aircraft of having to supply this information. The GPS receiver provides the location information to the GCU 40 to assist in guiding the bomb to the target. Such systems are known in the art as used in aircraft and missiles and need not be discussed in further detail here.

Another alternative is to use a seeker unit on the bomb in combination with the INS guidance package. The seeker could be, for example, radar sensing, laser seeker, or heat sensing type mounted to the nose of the bomb. These systems are also known in connection with missiles, for example, the GBU-27/B.

Once the dive line is established, the GCU 40 will prepare for rocket ignition. It is important that the bomb be aligned on the dive line, that is, that angle of attack be as close to 0° as possible, preferably no greater than 1°, when the rocket is fired or the rocket will drive the bomb from the dive line. The GCU 40 preferably includes accelerometers to sense lateral acceleration of the bomb. The GCU controls the wings and fins, and optionally other controllable surfaces, responsive to a signal from the accelerometers to eliminate lateral movements, and reduce the angle of attack to 0°. Alternatively, a thrust vector system, several of which are known in the art, could be provided to control lateral movements.

To minimize thrust misalignment during the rocket thrust, according to a preferred embodiment, the rocket nozzles are arranged in a circular pattern and are canted relative to the circular pattern to induce a roll in the bomb about the long axis as the rocket fires.

Another factor in optimizing penetration is the timing of the boost phase. The rocket booster must be fired with sufficient time before impact to accelerate to optimum velocity at impact. A typical booster motor is designed to accelerate the bomb by about 1000 feet per second in a burn time of about 1.2 seconds. The bomb control system includes an altimeter to measure altitude above sea level, and a processor to convert altitude to height above the target based on stored target altitude information. Alternatively, a radar altimeter could be provided to measure altitude above the target directly. The control system converts the height information to time to impact, and fires the rocket booster motor at a time sufficient for the bomb to achieve the acceleration. For most applications, the rocket will be fired at about 3000 feet above the target or about 2.8 seconds prior to impact at the free fall speed.

The penetrating body or penetrator 12 in the illustrative embodiment is designed for improved target penetrating capability. The penetrator must have sufficient strength for penetrating the protective layers of the target, and remain structurally intact. The penetrator may also be required to fragment after penetration under the force of the explosive for target destructive capability. The penetrator 12 includes a case formed of a hard, dense material, such as steel, tungsten, or depleted uranium. The material preferably has a tensile strength of 200 to 220 kpsi and high toughness of about 22 ft-lb Charpy V-notch. Suitable materials include D6AC steel, 4330 V Mod steel, and HP-9-4-20 steel.

The penetrator 12 is relatively narrow to provide a small cross sectional area to overall weight for optimum penetration capability. The penetrator 12 has an interior hollow space 13 that contains an explosive 14. The space 13 is open at the tail end of the penetrator and extends toward the nose 15, leaving a solid, nose section. A bulkhead is attached to the open tail end to close the opening at the tail and to support mounting of a fuze 60 that ignites the explosive, further described below.

The penetrator 12 is shaped at the nose end 15 with an ogive having a variable radius of curvature, which improves entry into the target structure. The nose end 15 outer shape leads to a cylindrical center portion 16 that houses the hollow interior 13.

As mentioned, the frontal cross sectional area is made relatively small so that the mass to frontal area ratio (M/A) is at a maximum for maximal penetration ability of the penetrator. The total mass includes the mass of the explosive. The mass allocation between penetrator and explosive is determined at least in part by the requirement that the penetrator wall thickness be sufficient to withstand the impact forces to maintain structural integrity.

Another consideration for maintaining structural integrity during penetration is the length to diameter ratio (L/D). As will be understood by those skilled in the art, when the nose of the penetrator contacts the target and begins penetration, it experiences deceleration forces. The deceleration forces are transmitted through the body of the penetrator to the tail end. If the body of the penetrator cannot withstand the deceleration forces, the body will bend or buckle. It has been found that for the velocities intended for the boosted penetrator, L/D must be not more than 11.

As an exemplary embodiment, a penetrator according to the invention has a length of 119 inches and an outer diameter of 10.9 inches for an L/D of 10.92. With a wall thickness of 1.4 inches, an explosive weight of 300 lbs can be accommodated for a total weight of about 1760 lbs. A rocket motor as described above weighs about 1000 lbs. Thus, a bomb according to the invention has an assembled weight of about 2760 lbs, which is within the range of qualified bombs.

The fuze 60 is an in-line solid state device capable of withstanding the acceleration environment of striking a target at more than 2000 feet per second. The fuze 60 is a so-called "smart" fuze capable of layer or void sensing. This fuze is programmable with information about the target's structure. Alternatively, the fuze includes an adjustable time delay for igniting the explosive, for example, 0 to 60 milliseconds after impact.

Figure 4:
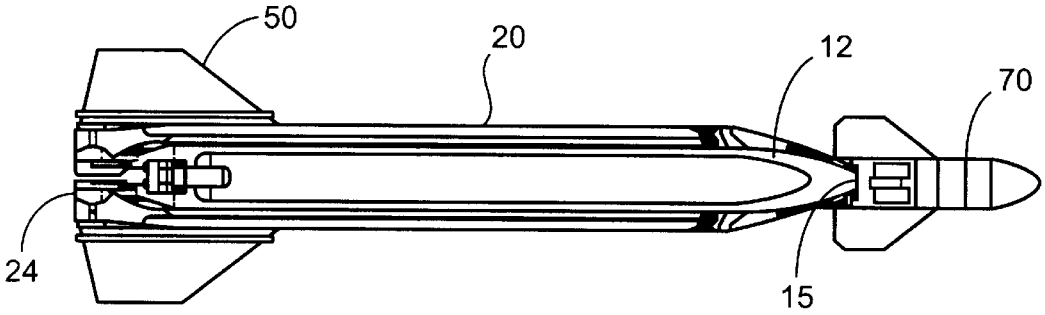
FIG. 4 is a schematic of an embodiment of the boosted penetrating bomb having a wrap around booster and forward mounted controls.

FIGS. 4–8 illustrate alternative structures for the boosted penetrating bomb. FIG. 4 shows a bomb with a wrap around rocket motor 20 and a control unit 40 mounted as part of a separate nose unit 70 on the nose of the penetrator 12. Fins on the guidance unit 70 and tail fins are used to control the flight path of the bomb.

Figure 5:
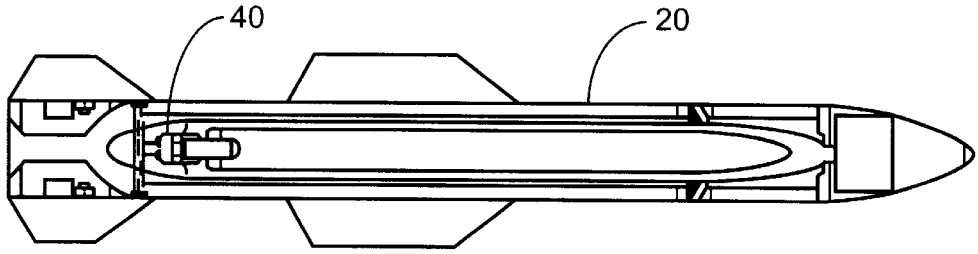
FIG. 5 is a schematic of an embodiment of the boosted penetrating bomb having a wrap around booster and rear mounted controls.

FIG. 5 shows a bomb with a wrap around motor 20 in which the guidance control unit 40 is mounted at the rear of the assembly. Mid-body positioned wings 80 and tail fins control the flight path. A seeker or GPS receiver is mounted in the nose 74 to provide position information to the control unit 40.

Figure 6:
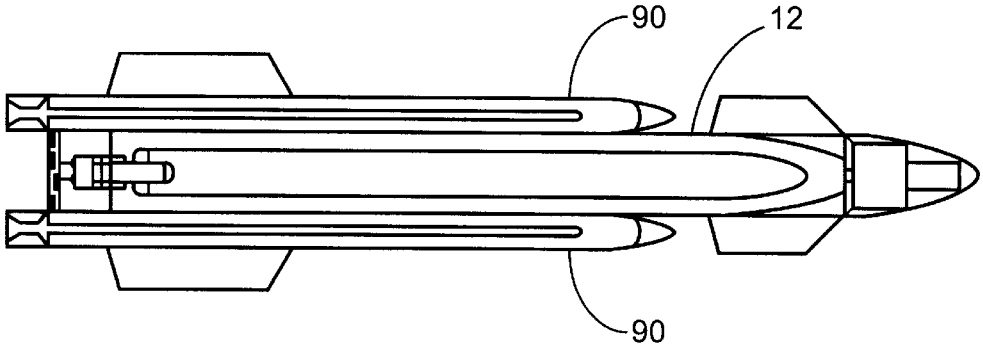
FIG. 6 is a schematic of an embodiment of the boosted penetrating bomb having a plurality of individual rocket motors mounted on the penetrator.

FIG. 6 illustrates a bomb with four individual rocket motors 90 strapped onto the penetrator 12. A separate forward unit 92 contains the guidance and control unit 40.

Figure 7:
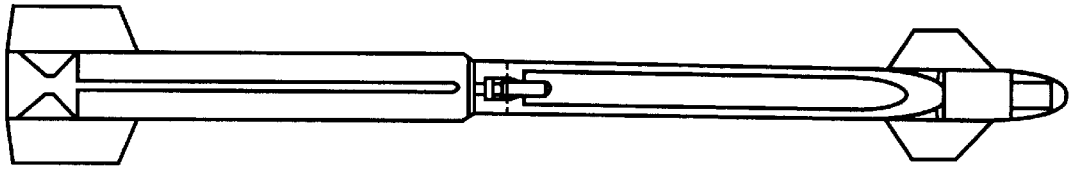
FIG. 7 is a schematic of an embodiment of the boosted penetrating bomb having a tandem mounted booster and forward mounted controls.

FIG. 7 illustrates a tandem structure, in which a rocket motor 26 is mounted axially aft of the penetrator 12*a*. To make the overall length of the penetrator 12*a* and rocket motor 26 compatible with existing aircraft bomb carrying structures, the penetrator 12*a* is shorter than the embodiment described above, approximately half the length, and proportionately less massive. A forward mounted unit 94 contains the guidance and control unit 40.

Figure 8:
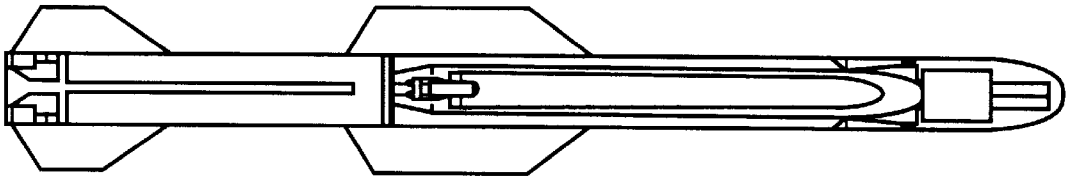
FIG. 8 is a schematic of an embodiment of the boosted penetrating bomb having a tandem mounted booster and rear mounted controls.

FIG. 8 shows a tandem arrangement in which the guidance and control unit 40 is mounted at the aft end of the bomb.

The tandem embodiments of FIG. 7 and FIG. 8 require increasing the overall length of the bomb to provide a penetrator as large as that of the wrap around embodiments, or reducing the size of the penetrator and rocket motor to allow the bomb to fit in existing aircraft bomb racks.

The invention has been described in terms of preferred embodiments, principles, and examples. Those skilled in the art will recognize that substitutions and equivalents may be made without departing from the scope of the invention as defined in the following claims.

What is claimed is:

1. A rocket-boosted penetrating bomb, comprising:

a penetrator having a hardened case with a hollow interior containing a payload;

a rocket booster motor mounted to the penetrator to accelerate the penetrator;

an outer skin enclosing at least the penetrator and providing an aerodynamic shape;

guiding means for guiding the bomb after release from an airborne vehicle in a glide phase and from the glide phase onto a guided dive line to a target;

controlling means for activating the rocket booster motor after the guiding means has guided the bomb onto the guided dive line; and, a fuze for initiating the payload after impact with a target.

2. The bomb as claimed in claim 1, wherein the rocket booster motor comprises an elongated, annular propellent chamber, wherein the penetrator is disposed in a central space defined by the annular chamber.

3. The bomb as claimed in claim 1, wherein the rocket booster motor comprises a plurality of individual rocket motors mounted about the circumference of the penetrator.

4. The bomb as claimed in claim 1, wherein the rocket motor comprises a propellant chamber and nozzle mounted in tandem to an aft end of the penetrator.

5. The bomb as claimed in claim 1, wherein the fuze including means for sensing movement of the penetrator through structural layers of a target and for activating the fuze responsive to movement through a predetermined number of layers.

6. The bomb as claimed in claim 1, wherein the fuze includes a delay timer for measuring a time interval after initial impact and delaying igniting the explosive until elapse of the measured time interval.

7. The bomb as claimed in claim 1, wherein the outer skin provides an outer shape that emulates an aerodynamic outer shape of a flight qualified bomb.

8. The bomb as claimed in claim 1, wherein said guidance means includes an inertial navigation system having means for communicating with a global positioning system.

9. The bomb as claimed in claim 1, wherein said guidance means includes a target seeker having means for sensing energy radiating from a target.

10. The bomb as claimed in claim 1, wherein said guidance means includes a plurality of air vanes and means for moving the air vanes to steer the bomb.

11. The bomb as claimed in claim 10, wherein the air vanes include wings attached at a middle portion of the bomb and fins attached at the aft end of the bomb.

12. The bomb as claimed in claim 1, wherein said guidance means includes thrust vector steering means for adjusting an angle of attack of the bomb, said thrust vector steering means being active during rocket boost.

13. The bomb as claimed in claim 1, wherein the rocket motor comprises a plurality of exhaust nozzles, the nozzles being canted with respect to a longitudinal axis of the bomb to produce a roll on the longitudinal axis.

14. The bomb as claimed in claim 1, wherein said controlling means includes means for sensing distance from a target and calculating a time duration before target impact, and responsive to said calculated time duration, activating the rocket motor to achieve a predetermined velocity at target impact.

15. The bomb as claimed in claim 1, wherein the payload comprises an explosive.

16. The bomb as claimed in claim 1, wherein the payload is selected from the group comprising fragmenting bomblets, chemicals, incendiaries, and radioactive material.

17. The bomb as claimed in claim 1, wherein an outer surface of the rocket booster motor forms at least a part of the outer skin.

* * * * *